United States Patent [19]

Yoshiki et al.

[11] Patent Number: 4,712,407

[45] Date of Patent: Dec. 15, 1987

[54] APPARATUS FOR WORKING SURFACE OF METAL PIPE

[75] Inventors: Naokazu Yoshiki; Yutaka Saito; Tsuneo Haba, all of Kitamoto, Japan

[73] Assignee: Mitsubishi Kinzoku Kabushiki Kaisha, Tokyo, Japan

[21] Appl. No.: 725,275

[22] Filed: Apr. 19, 1985

[30] Foreign Application Priority Data

Mar. 30, 1985 [JP] Japan ..... 60-46948

[51] Int. Cl.[4] ..... B21B 23/00

[52] U.S. Cl. ..... 72/68; 72/78

[58] Field of Search ..... 72/68, 78, 121

[56] References Cited

U.S. PATENT DOCUMENTS 3,363,442 1/1968 Kennedy et al. ..... 72/78
3,452,567 7/1969 Marcovitch ..... 72/78

FOREIGN PATENT DOCUMENTS 934583 10/1973 Canada ..... 72/78
635015 8/1936 Fed. Rep. of Germany .
3047789 9/1984 Fed. Rep. of Germany .
112929 7/1982 Japan ..... 72/78
423551 4/1974 U.S.S.R. ..... 72/78
841714 7/1981 U.S.S.R. ..... 72/78

*Primary Examiner*—Lowell A. Larson
*Attorney, Agent, or Firm*—Cushman, Darby & Cushman

[57] ABSTRACT

An apparatus for working a surface of a metal pipe is provided. The apparatus comprises a drawing unit for drawing a metal pipe to reduce a diameter thereof, and a working assembly for working the diameter-reduced metal pipe to form an inner surface and/or an outer surface thereof into a predetermined configuration. The working assembly includes a rolling unit and a driving mechanism therefor. The rolling unit includes a housing, a plurality of rolling rolls rotatably disposed within the housing and outside the metal pipe so that the rolling rolls have their respective axes extending at an inclination angle with respect to an axis of the metal pipe. The rolling rolls are respectively mounted on support shafts rotatably supported in the housing through thrust bearings. The driving mechanism drivingly rotates the rolling unit to revolve the rolling rolls around the metal pipe. The rolling unit is removably mounted on the driving mechanism.

7 Claims, 4 Drawing Figures

APPARATUS FOR WORKING SURFACE OF METAL PIPE

BACKGROUND OF THE INVENTION

1. Field of the Invention

The present invention relates to an apparatus for working a metal pipe to form an irregularity or a helical groove in an inner surface and/or an outer surface of the metal pipe.

2. Prior Art

A metal pipe such as copper pipe and aluminum pipe, for example, for use in heat-exchangers, is formed with an irregularity or a helical groove not only in an outer surface of the metal pipe, but also in an inner surface thereof, in order to improve heat transfer.

Referring to FIG. 1, a pipe working apparatus of the prior art for forming an irregularity or a helical groove in an inner surface of a metal pipe 1 is fundamentally arranged such that the metal pipe 1 is delivered axially of the pipe and is caused to pass through a drawing unit 2 which comprises a die 2*a* and a drawing plug 2*b*, so that the pipe is reduced in diameter so as to have predetermined wall thickness and diameter. A helical groove is formed in the inner surface of the diameter-reduced metal pipe 1 by a pipe working assembly 4 which comprises rolling rolls 5 in pressure contact with an outer surface of the metal pipe 1, and an inner surface working plug 6 floatingly disposed within the metal pipe 1 at a position corresponding to the rolling rolls 5. The rolling rolls 5 are rotatably supported by a ring-like support 7 through arms 8 of a driving mechanism (not shown) which revolves the rolling rolls 5 around the metal pipe 1, with respective axes of the rolling rolls 5 being inclined at a predetermined angle with respect to an axis of the metal pipe 1.

The pipe working apparatus of the kind described above has such advantages that it is possible to increase forming rate and working speed to improve productivity of the apparatus, and it is also possible to work metal pipes having considerable axial length.

With the pipe working apparatus, however, it is frequently required to adjust respective positions of the rolling rolls 5 dependent upon the wall thickness or diameter of the rolled metal pipe 1. In this regard, the pipe working apparatus of the prior structure has such problems that since the rolling rolls 5 are fixedly connected to the ring-like support 7 by means of the arms of the driving mechanism, it is difficult to adjust the respective positions of the rolling rolls 5 so that considerable time is required for the arrangement and setting of the apparatus, resulting in the deterioration of workability and operability. In addition, there is also a problem that because of the complexity in structure, the maintenance of the apparatus is troublesome.

SUMMARY OF THE INVENTION

It is therefore an object of the present invention to provide a pipe working apparatus in which rolling rolls are assembled as a rolling unit to facilitate the maintenance to enable the time required for the arrangement and setting to be decreased, to thereby improve the operability, and the structure is simplified to enable the possibility of malfunction of the apparatus to be reduced.

According to the present invention, there is provided a pipe working apparatus for working at least one of inner and outer surfaces of a metal pipe comprising:

means for drawing the metal pipe to reduce a diameter thereof; means for working the inner and outer surfaces of the metal pipe to form the inner surface thereof into a predetermined configuration; and the working means including a rolling unit and a driving mechanism therefor, the rolling unit including a housing, a plurality of rolling rolls rotatably disposed within the housing and outside the metal pipe so that the rolling rolls have their respective axes extending at an inclination angle with respect to an axis of the metal pipe and are in pressure contact with the metal pipe, and support shafts each having axial opposite ends thereof rotatably supported by the housing through thrust bearing means, the rolling rolls being respectively mounted on the support shafts, the rolling unit being removably mounted on the driving mechanism and driven by the driving mechanism to revolve the rolling rolls around the metal pipe, the working means further including an inner surface working plug floatingly disposed within the metal pipe at a position corresponding to the rolling rolls.

The pipe working apparatus according to the present invention is arranged such that the rolling unit having incorporated thereinto the rolling rolls are drivingly rotated by the driving mechanism to revolve the rolling rolls around the metal pipe. Such arrangement of the apparatus enables the inner surface of the metal pipe to be worked without any sacrifice of the advantages of the prior art apparatus. In addition, it is possible to easily replace the rolling unit with another one, to enable the rolling rolls to be replaced by ones of different type.

DESCRIPTION OF THE PREFERRED EMBODIMENT OF THE INVENTION

The present invention will be described, by way of a mere example, with reference to the accompanying drawings.

Figure 1:
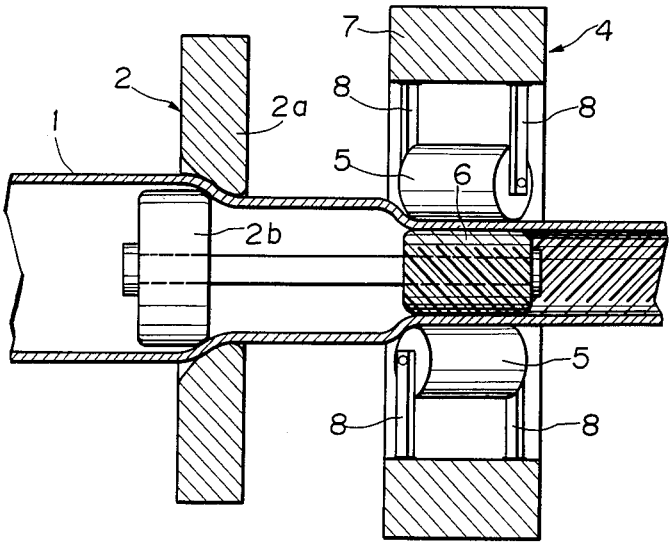
FIG. 1 (PRIOR ART)
FIG. 1 is a fragmental cross-sectional view showing a pipe working apparatus of the prior art.
Figure 3:
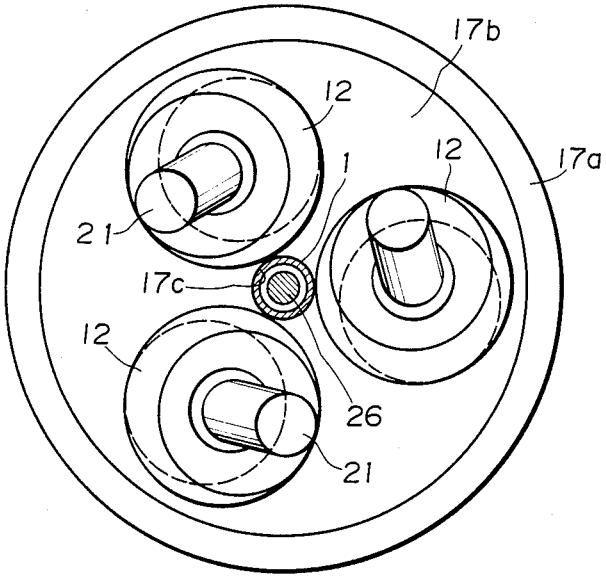
FIG. 3 is a fragmental cross-sectional view diagrammatically showing the pipe working apparatus for the purpose of explanation of an operation thereof.
Figure 2:
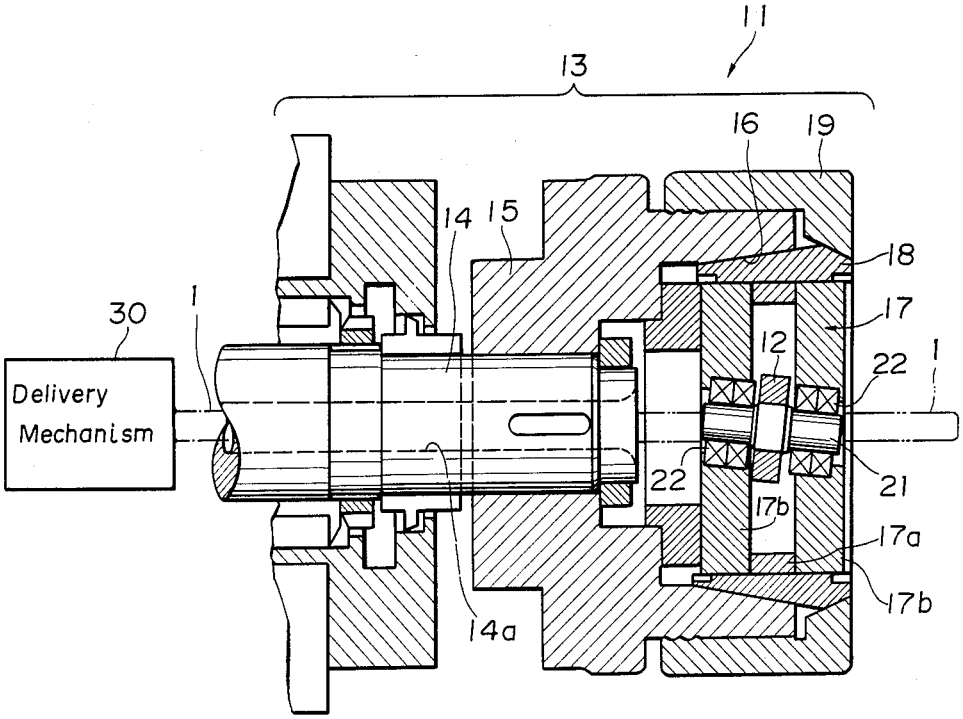
FIG. 2 is a fragmental cross-sectional view showing a pipe working assembly of a pipe working apparatus according to an embodiment of the present invention.
Figure 4:
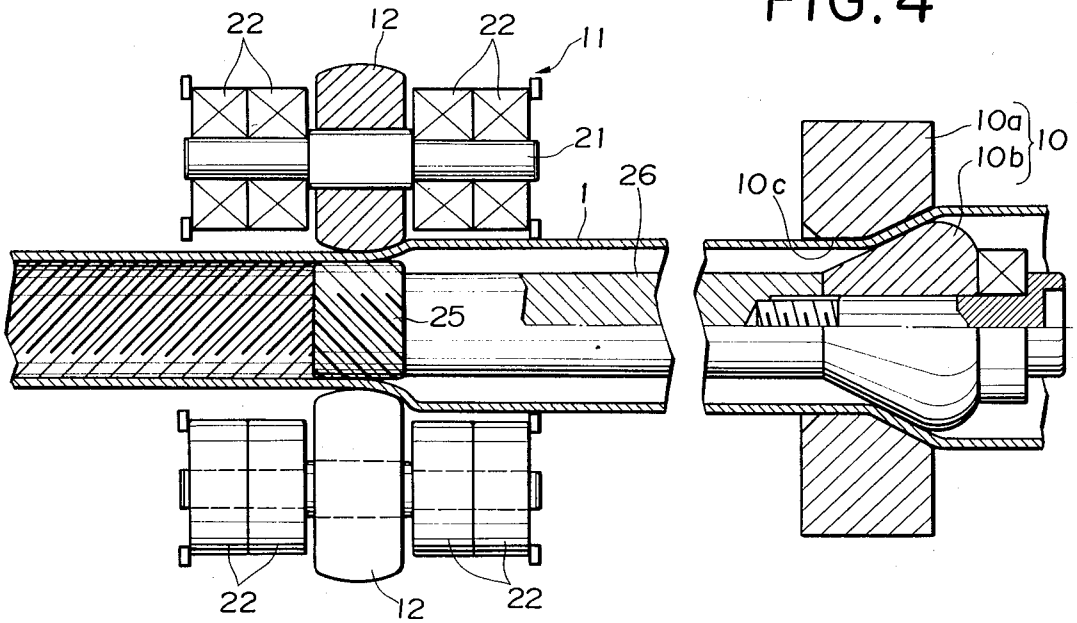
FIG. 4 is a side elevational view showing a rolling unit incorporated into the pipe working assembly, with one of a pair of end members being removed to show rolling rolls.

FIGS. 2 to 4 of the drawings illustrate a pipe working apparatus according to an embodiment of the present invention. The apparatus is fundamentally similar in structure to the prior art apparatus, and comprises a drawing unit 10 including a die 10*a* and a drawing plug 10*b* for rolling a metal pipe 1, a pipe working assembly 11 disposed downstream of the drawing unit 10 with reference to the movement of the metal pipe 1, for forming a predetermined configuration (helical configuration in the illustrated embodiment) in an inner surface of the metal pipe 1 worked by the drawing unit 10, and a delivery mechanism 30 disposed downstream of the working assembly 11 for delivering the metal pipe 1 axially thereof.

The present invention is characterized particularly in that the rolling rolls 12 of the working assembly 11 is assembled as a rolling unit 17 which is removable from the driving mechanism 13. The working assembly 11 will be described hereinafter in detail.

As shown in FIG. 2, the driving mechanism 13 comprises an output shaft 14 having formed therethrough an axial bore 14*a* for allowing the metal pipe 1 to pass therethrough. The output shaft 14 has a free end thereof on which a generally cylindrical connecting flange 15 is fixedly mounted for rotation therewith. The connecting flange 15 has formed therein a recess which has a peripheral wall surface 16 tapered so as to diverge away from the free end of the output shaft 14. The rolling unit 17 having a cylindrical peripheral surface is received in the recess in the connecting flange 15 through a split sleeve 18 and is secured in position within the recess by a cup-shaped cap member 19 which is threadedly engaged with the connecting flange 15 and which is also engaged with the split sleeve 18. The split sleeve 18 has an outer peripheral surface thereof complementary with the tapered peripheral wall surface 16 of the recess in the connecting flange 15 and an inner peripheral surface complementary with the cylindrical peripheral surface of the rolling unit 17. Although the illustrated embodiment is arranged such that the rolling unit 17 is received in the connecting flange 15, the connecting flange 15 may comprise a receiving section receiving therein the rolling unit 17 (i.e., a section having formed therein the recess having the tapered peripheral wall surface 16) and a section separate from the receiving section and mounted on the free end of the output shaft 14.

The rolling unit 17 comprises, in addition to the rolling rolls 12, a housing which includes an annular holder 17*a* having axial opposite end faces and a pair of end members 17*b* respectively attached to the axial end faces of the holder 17*a* by means of any suitable fastening means such as bolts. Each of the end members 17*b* has formed therein a central bore 17*c* (cf. FIG. 3) for allowing the metal pipe 1 to pass through the rolling unit 17. A plurality of (three in the illustrated embodiment) rolling rolls 12 are rotatably supported between the end members 17*b* through respective support shafts 21, such that the rolling rolls 12 have their respective axes inclined at a predetermined angle with respect to the axis of the metal pipe 1 and are in pressure contact therewith. Each of the support shafts 21 has one end thereof rotatably supported at one side of the associated rolling roll 12 by one of the pair of end members 17*b* by means of thrust bearings 22 received in an associated recess in the one end member 17*b* and the other end rotatably supported at the opposite side of the associated rolling roll 12 by the other end member 17*b* through thrust bearings 22 received in an associated recess in the other end member 17*b* .

An inner surface working plug 25 is disposed in a floating manner within the metal pipe 1 at a position corresponding to the rolling rolls 12 and is rotatably connected to the drawing plug 10*b* through a rod 26.

An operation of the pipe working apparatus of the structure described above for working the metal pipe 1 will be described.

In order to mount the rolling rolls 12 on the driving mechanism 13 as shown in FIG. 2, the rolling unit 17 having incorporated thereinto a plurality of the rolling rolls 12 is inserted and received in the recess in the connecting flange 15 through the split sleeve 18, and then the cap member 19 is threadedly engaged with the connecting flange 15 and is also engaged with the split sleeve 18 to urge the same. By this operation, the rolling unit 17 is tightly in pressure contact with the tapered peripheral wall surface 16 of the recess in the connecting flange 15, and is positively drivingly connected to the output shaft 14 of the driving mechanism 13.

Subsequently, with the rolling unit 17 being secured to the connecting flange 15, the drawing plug 10*b* and the inner surface working plug 25 together with the rod 26 connecting the plugs 10*b* and 25 to each other are inserted in a predetermined direction into the metal pipe 1 which is a workpiece. Then, the metal pipe 1 is disposed such that the metal pipe 1 extends through a central working bore 10*c* in the die 10*a*, and further through the respective bores 17*c* in the end members 17*b* of the rolling unit 17 and through the bore 14*a* in the output shaft 14, and then one end of the metal pipe 1 is gripped by the delivering mechanism. Subsequently, the driving mechanism 13 is operated to rotate the output shaft 14 to rotate the rolling unit 17, to thereby cause the rolling rolls 12 thereof to be revolved around the metal pipe 1, and the delivery mechanism is driven to deliver the metal pipe 1 from the right to the left in FIG. 4 to initiate the working of the inner surface of the metal pipe 1.

At the outset, when the metal pipe 1 is caused to pass through the drawing unit 10, the pipe 1 is reduced in diameter so as to have predetermined diameter and wall thickness by means of the die 10*a* and the drawing plug 10*b*, and then, when the pipe 1 is caused to pass through the working assembly 11, a helical groove is formed in the inner surface of the metal pipe 1. When the working assembly 11 is in a driven condition, the rolling unit 17 having incorporated thereinto the rolling rolls 12 is rotated by the driving mechanism 13, so that each rolling roll 12 is revolved around the metal pipe 1 and is rotated around its own axis because the rolling roll 12 is tightly in pressure contact with the outer surface of the pipe 1. Since each rolling roll 12 has its axis inclined at a predetermined angle with respect to the axis of the metal pipe 1, when the rolling rolls 12 are rotated in pressure contact with the metal pipe 1, frictional force occurring between the metal pipe 1 and the rolling rolls 12 has an axial component which becomes a thrust force tending to deliver the metal pipe 1, so that the metal pipe 1 is subjected to a force in such direction that the metal pipe 1 is delivered. Simultaneously therewith, since the rolling rolls 12 are tightly in pressure contact with the outer surface of the metal pipe 1, the inner surface of the metal pipe 1 is brought into pressure contact with the inner surface working plug 25 and the helical groove is formed in the inner surface of the metal pipe 1. At this time, due to the frictional force with respect to the metal pipe 1, the inner surface working plug 25 is subjected to a force in such direction that the metal pipe 1 is delivered. However, since the plug 25 is connected to the drawing plug 10*b* through the rod 26, the plug 25 is continuously retained in a position corresponding to the rolling rolls 12.

As described above, the rotation of the rolling rolls contains a component tending to deliver the metal pipe 1. The component acts in such direction as to positively deliver the metal pipe 1, to thereby enable the forming rate on the metal pipe 1 to be increased. In addition, the force imparted to the metal pipe 1 by the rolling rolls 12 is perpendicularly applied to the outer surface of the metal pipe 1 and is divided into an urging force tending to roll the metal pipe 1 and a force opposite to the frictional force occurring in the direction perpendicular to the urging force. However, since the rolling rolls 12 are mounted so as to have their respective axes inclined with respect to the axis of the metal pipe 1, the frictional force is extremely decreased and, accordingly, the force opposite to the frictional force is also extremely decreased. This causes the force imparted to the metal pipe 1 by the rolling rolls 12 to be decreased, but the forming rate on the metal pipe 1 is maintained unchanged because the urging force tending to roll the metal pipe 1 does not vary.

Moreover, the decrease in the frictional force causes a tension force applied to the metal pipe 1 to be reduced. Thus, should depth of the groove on the inner surface working plug 25 be increased by the difference corresponding to the reduction in the tension force to increase the forming rate on the metal pipe 1, the metal pipe 1 would not be damaged.

Additionally, if the rolling rolls 12 are desired to be replaced with another ones, the cap member 19 is disengaged from the connecting flange 15 to remove the rolling unit 17, and another rolling unit is mounted in the connecting flange 15 by the aforementioned procedure. Furthermore, when the rolling rolls 12 are rotated in pressure contact with the metal pipe 1, the metal pipe 1 is subjected to a torsional force in such direction that the rolling rolls 12 are rotated, due to a part of the frictional force occurring between the rolling rolls 12 and the metal pipe 1. However, since the metal pipe 1 is reduced in diameter and is prevented from being rotated by the drawing unit 10, no torsion of the metal pipe 1 occurs.

Furthermore, the inner surface working plug 25 is subjected to a rotational force around an axis of the plug 25 by the frictional force with respect to the metal pipe 1. However, since the plug 25 is rotatable with respect to the rod 26, the plug 25 is rotated in dependence upon the rotating force and, accordingly, the helical groove formed in the inner surface of the metal pipe 1 is prevented from being deformed.

Also, the rolling rolls 12 are subjected to a tension force longitudinally of the metal pipe 1 due to the fact that the metal pipe 1 is pulled. However, the tension force is received by the thrust bearings 22 to improve the reliability and durability of the rolling rolls 12 and the support shafts 21 therefor of the rolling unit 17.

In the illustrated embodiment, each rolling roll 12 has a peripheral surface which is convexly arcuated in cross-section in a plane including the axis of the rolling roll. However, each rolling roll 12 may have a peripheral surface which is concavely arcuate in the cross-section in the plane including the axis of the rolling roll. This allows a high load to be prevented from being applied to the metal pipe 1, to enable a superior rolling to be performed. In addition, the forming of a predetermined configuration in the outer surface of each rolling roll 12 enables a corresponding predetermined configuration to be formed in the outer surface of the metal pipe 1.

As described above, according to the present invention, there are provided such advantages that the maintenance of the apparatus is facilitated without sacrifice of the superior advantages of the prior art working apparatus, it is possible to use various sizes of rolling rolls by the replacement of the rolling unit with another one, the replacement operation is facilitated to enable time required for arrangement and setting to be reduced to improve the operability, and the simple structure can improve the reliability of the apparatus.

What is claimed is:

1. An apparatus for working inner and outer surfaces of a metal pipe comprising:

means for drawing the metal pipe to reduce a diameter thereof;

means for working the inner and outer surfaces of the metal pipe to form at least one of the inner and outer surfaces thereof into a predetermined configuration; and said working means including a rolling unit and a driving mechanism therefor, said rolling unit including a housing having end members each provides with a central bore, a plurality of rolling rolls rotatably disposed within said housing and outside the metal pipe so that said rolling rolls have their respective axes extending at an inclination angle with respect to an axis of the metal pipe and are in pressure contact with the metal pipe, and support shafts each having axial opposite ends thereof rotatably supported by said housing through thrust bearing means, said rolling rolls being respectively mounted on said end members on said driving mechanism and driven by said driving mechanism to revolve said rolling rolls around the metal pipe, said working means further including a plug floatingly disposed within the metal pipe at a position corresponding to said rolling rolls, said driving mechanism comprising an outpput shaft having a free end and having therein an axial bore for allowing the metal pipe to pass therethrough, a connecting flange mounted on said free end of said output shaft for rotating therewith, said connecting flange having formed therein a recess, and a cap member threadedly engaging with said connecting flange for securing said rollng unit within said recess so that said axial bore in said output shaft is in coaxial communication with the respective central bores in said end members of said housing; said recess in said connecting flange having a peripheral wall surface tapering so as to diverge away from the free end of said output shaft, said cap member having a tapered surface tapering so as to diverge toward the free end of said output shaft, said driving mechanism further comprising a split sleeve having an inner peripheral surface thereof and an outer peripheral surface comprising a first tapered surface and a second tapered surface, said first tapered surface tapering so as to diverge toward the free end of said output shaft, said second tapered surface tapering so as to diverge away from the free end of said output shaft, said split sleeve being disposed in position with said first tapered portion being engaged with the peripheral wall surface of said recess in said connecting flange while said second tapered portion is engaged with the tapered surface of said cap member, so that the split sleeve is deformed into a shape of a reduced diameter to be brought into firm engagement with the outer peripheral surface of the rolling unit, thereby securing the rolling unit in position.

2. A pipe working apparatus defined in claim 1 further comprising means for delivering the metal pipe axially thereof.

3. A pipe working apparatus defined in claim 2, wherein the respective axes of said rolling rolls are inclined with respect to the axis of the metal pipe in such direction that said rolling roll, when said rolling unit is rotated, imparts to the metal pipe a thrust force tending to move the metal pipe axially thereof away from said drawing means.

4. A pipe working apparatus defined in claim 3, wherein said housing comprises an annular holder having axial opposite end faces and a pair of end members respectively attached to the axial opposite end faces of said annular holder so that said rolling unit has a cylindrical outer peripheral surface, each of said support shafts having one end thereof rotatably supported by one of said pair of end members through said bearing means and the other end rotatably supported by the other end member through said bearing means, each of said end members having therein a central bore for allowing the metal pipe to pass therethrough.

5. A pipe working apparatus defined in claim 4, wherein each of said rolling rolls has a circumferential surface which is arcuate in cross-section in a plan including the axis of the rolling roll.

6. A pipe working apparatus defined in claim 1, wherein the respective axes of said rolling rolls are inclined with respect to the axis of the metal pipe in such direction that said rolling roll, when said rolling unit is rotated, imparts to the metal pipe as a thrust force tending to move the metal pipe axially thereof away from said drawing means.

7. A pipe working apparatus defined in claim 1, including three rolling rolls circumferentially equi-distantly spaced from each other.

* * * * *